US011419375B2

(12) United States Patent
Rangel

(10) Patent No.: US 11,419,375 B2
(45) Date of Patent: Aug. 23, 2022

(54) HIDDEN ROW HAIR EXTENSION METHOD

(71) Applicant: Adrianne Toni Rangel, Henderson, CO (US)

(72) Inventor: Adrianne Toni Rangel, Henderson, CO (US)

( * ) Notice: Subject to any disclaimer, the term of this patent is extended or adjusted under 35 U.S.C. 154(b) by 326 days.

(21) Appl. No.: 16/400,082

(22) Filed: May 1, 2019

(65) Prior Publication Data

US 2019/0357614 A1 Nov. 28, 2019

Related U.S. Application Data

(60) Provisional application No. 62/666,338, filed on May 3, 2018.

(51) Int. Cl.
*A41G 5/00* (2006.01)

(52) U.S. Cl.
CPC ..... *A41G 5/006* (2013.01); *A41G 5/0086* (2013.01)

(58) Field of Classification Search
CPC ..... A41G 5/00; A41G 5/0013; A41G 5/002; A41G 5/0026; A41G 5/004; A41G 5/0046; A41G 5/0053; A41G 5/006; A41G 5/0006; A41G 5/0066; A41G 5/0073; A41G 5/0086; A41G 3/00; A41G 3/0008; A41G 3/00126; A41G 3/0033; A45D 2007/002; A45D 2007/004; A45D 2007/007; A45D 24/00; A45D 24/34; A45D 2024/345
USPC ..... 132/201, 53, 54, 55
See application file for complete search history.

(56) References Cited

U.S. PATENT DOCUMENTS

| | | | | |
|---|---|---|---|---|
| 5,121,761 | A * | 6/1992 | Meister | A41G 5/0053 132/201 |
| 6,253,771 | B1 * | 7/2001 | McClaine | A45D 24/10 132/148 |
| 7,661,434 | B2 * | 2/2010 | Frazier | A41G 5/006 132/201 |
| 9,596,898 | B2 * | 3/2017 | Seawright | A41G 5/006 |
| 2005/0061346 | A1 * | 3/2005 | Song | A41G 5/004 132/201 |
| 2010/0275940 | A1 * | 11/2010 | Kallabat | A41G 5/0066 132/53 |
| 2013/0042881 | A1 * | 2/2013 | Mutchler | A41G 5/0026 132/201 |
| 2013/0167858 | A1 * | 7/2013 | Lee | A41G 5/0066 132/201 |
| 2014/0060566 | A1 * | 3/2014 | Walker | A41G 5/0073 132/201 |
| 2014/0326267 | A1 * | 11/2014 | Peterson | A41G 5/004 132/201 |

* cited by examiner

*Primary Examiner* — Rachel R Steitz
*Assistant Examiner* — Karim Asqiriba
(74) *Attorney, Agent, or Firm* — Akaweih Law; Maymanat Afshar; Nadia Akaweih

(57) ABSTRACT

The present disclosure is drawn to weft hair extensions, and a method for attaching hidden rows of weft hair extensions to a wearer's natural hair. The hidden row of weft hair extensions is unexposed and undetectable on a wearer, allowing for a fuller, longer, more natural appearance.

10 Claims, 9 Drawing Sheets

HIDDEN ROW HAIR EXTENSION METHOD

CROSS REFERENCE TO RELATED APPLICATIONS

The present application claims priority to U.S. Patent Application No. 62/666,338 filed on May 3, 2018, which is hereby incorporated by reference in its entirety herein.

FIELD OF THE INVENTION

This disclosure relates to a method of attaching weft hair extensions to a wearer's natural hair, and a method of use for installing a hidden row of weft hair extensions to the wearer to provide additional length, volume, and thickness to the hair.

BACKGROUND

Hair extensions or wefts of hair are made up of a plurality of strands of supplemental hair. Hair extensions are used for cosmetic purposes and are applied to a wearer's scalp by using human hair or synthetic hair in order to add length and/or fullness to human hair. Synthetic hair extensions are manufactured artificially. Hair extensions are available in different colors and textures.

Hair extensions have become extremely popular, yet extremely expensive. The hair extension method chosen typically depends on a wearer's budget, hair preference, and hair type. Today, there are many forms of hair extension methods. The most common methods for applying hair extensions are fusion hair extensions, tape-in hair extensions, and weave hair extensions. Fusion hair extensions, also known as bonded hair extensions, are applied by fusing individual keratin-tipped strands to a wearer's natural hair using heat. Fusion hair extensions tend to be the most expensive, have the most time-consuming application process, and last the longest. Cold Fusion Hair Extensions are strand-by-strand hair extensions that use a keratin-based polymer to attach hair extensions to the root. Cold Fusion extensions use ultrasound waves that are transformed into mechanical energy. The vibration caused by the ultrasound energy is directed where the keratin meets the wearer's natural hair. The vibration crystalizes the bond forming the long-lasting hold. Tape-in hair extensions are applied by attaching wefts of hair to small sections of a wearer's natural hair using durable, double-sided, invisible, adhesive tape. The tape-in hair extension application process is much faster and more affordable but requires more frequent maintenance. Weave hair extensions, also known as sew-in hair extensions, are applied by braiding a wearer's natural hair in rows from ear-to-ear and weaving (with thread) wefts of hair onto the braids. Weave-in hair extensions last about three months, can be applied in an hour or two, and are the most affordable option of the bunch.

Other hair extension methods include natural beaded rows hair extensions, glue-in hair extensions, clip-in hair extensions, halo hair extensions, micro link strand-by-strand hair extensions, micro link skin weft hair extensions, and pre-bonded micro loop hair extensions.

Hair extensions are widely known to provide a wearer with a fuller look, however, most hair extensions can be easily detectable in a wearer. It is important to match the color and texture of the hair extensions with that of a wearer's natural hair, so that the hair extensions are undetectable and concealed between the wearer's natural hair. The present method uses invisible, slip-proof, non-damaging attachments for concealment purposes. Thus, it is an object of the present disclosure to provide a method that allows a wearer's hair extensions to go unnoticeable.

A persistent problem with hair extension application is that the scalp attached human hair is damaged in the application process, either from the glue, heat, bonding, or adhesives used in securing the hair extension to the wearer. It is another object of the present disclosure to provide a method for attaching hair extensions which allows the hair extensions to be easily removed, without damaging the wearer's naturally growing hair.

It is an object of the present disclosure to provide a safer hair extension method that minimizes bumps, gaps, and crevices within the lengths of the hairs and prevents hair brushes or combs from being trapped to facilitate smooth hair brushing, preventing the wearer from hair breakage and natural hair damage.

Thus, the present disclosure provides an undetectable hidden row hair extension method that safely and timely applies weft hair extensions to the wearer, adding length, volume, and thickness to the hair, such as the one described herein.

The present disclosure of this application is more fully described below.

SUMMARY

An exemplary embodiment of the present disclosure provides a new and improved hair extension method concealing hidden rows of weft hair extensions in between layers of human scalp hair. It is therefore an object of the present disclosure to provide a hair extension method that is both unexposed and undetectable in the wearer, allowing for a more natural appearance.

The method of the present disclosure further provides clients with a safer alternative for attaching hair extensions by using invisible, slip-proof, non-damaging attachments, in order to prevent natural hair breakage.

It is a further object of the present disclosure to provide a method of attaching hair extensions that remain in place up to eight weeks.

Another object of the present disclosure is to provide a method which is efficient and effective in use, as well as economical, with respect to its component parts and manufacturing processes to assist the wearer.

In addition to the reliability and increased safety and support of the present disclosure, the present method minimizes stress on the wearer's natural hair, providing a quick installation (less than two hours), and maintenance process (less than one hour), as desired.

BRIEF DESCRIPTION OF THE DRAWINGS

For an understanding of embodiments of the disclosure, reference is now made to the following description taken in conjunction with the accompanying drawings, in which.

In the Figures, the same reference numerals are used for components which are identical or similar, even if a repeated description is superfluous for reasons of simplicity.

DETAILED DESCRIPTION

Figure 1:
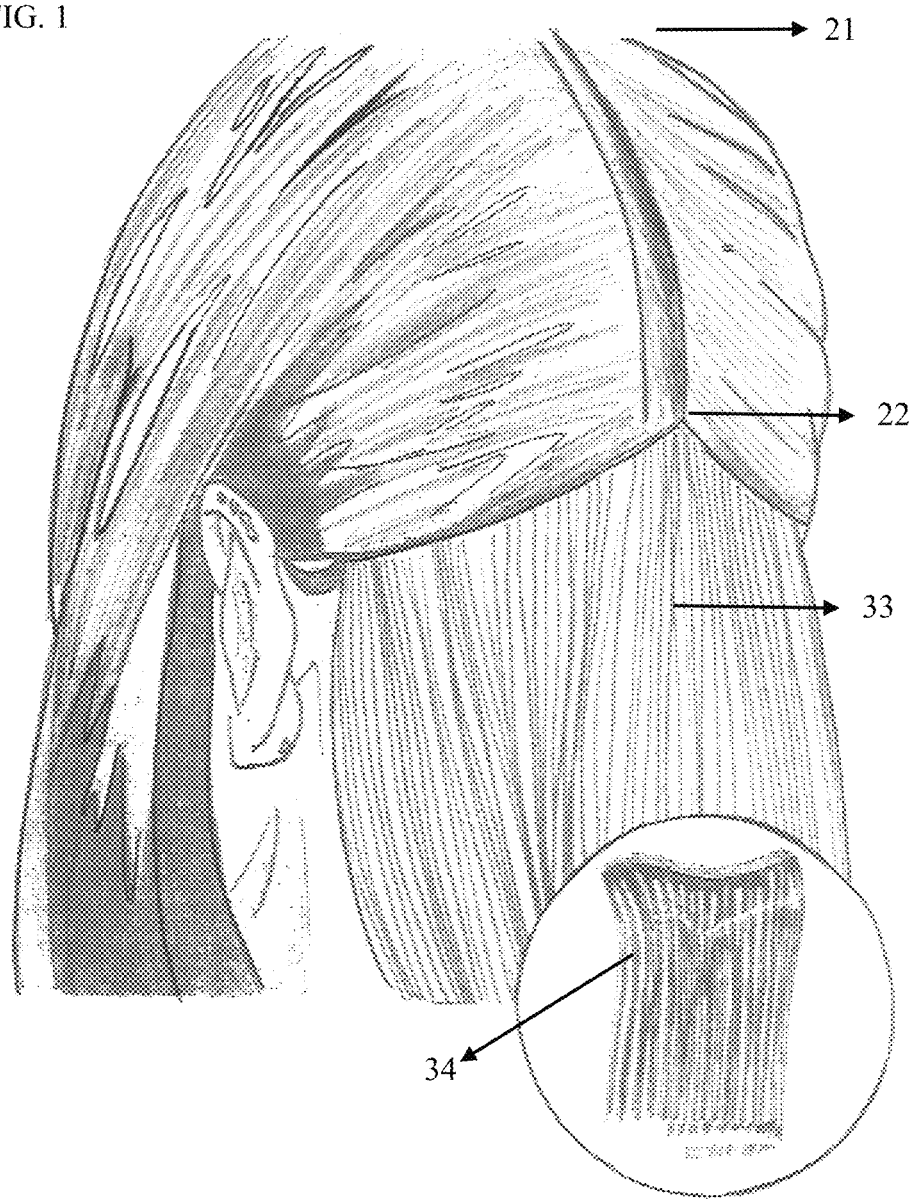
FIG. 1 illustrates a rear view of a wearer's head, further showing a step of installing weft hair extensions, upon which the method of the present disclosure, in accordance with an embodiment, is practiced.

The following detailed description is merely exemplary in nature and is not intended to limit the disclosure or the application and uses of the disclosure. As used herein, the word "exemplary" means "serving as an example, instance, or illustration." Thus, any embodiment described herein as "exemplary" is not necessarily to be construed as preferred or advantageous over other embodiments. Furthermore, there is no intention to be bound by any expressed or implied theory presented in the preceding technical field, background, brief summary, or the following detailed description.

For ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present disclosure is not limited by the usage of the terms shown below, as all equivalents, synonyms, new developments, and terms or methods that serve the same or a similar purpose are considered to be within the scope of the present claims.

In this description, reference is made to the drawings, wherein like parts are designated with like reference numerals throughout. As used in the description herein and throughout, the meaning of "a," "an," and "said" includes plural reference unless the context clearly dictates otherwise. Also, as used in the description herein, the meaning of "in" includes "into" and "on" unless the context clearly dictates otherwise.

In this description, relational terms, such as "first" and "second," "top" and "under," "front" and "rear," and the like are used solely to distinguish one entity or element from another entity or element without necessarily requiring or implying any physical or logical relationship or order between such entities or elements.

As used in this description, the terms "human hair," "natural hair," "scalp hair," and "naturally growing hair" refers to existing hair or hair that grows naturally from the scalp of the wearer.

As used in this description, the term "beads" and "micro links" as used herein is intended to mean any device that is able to secure two bundles of hair together. For example, the beads may include silicone lined micro links, clips, deformable devices (e.g., deformable cylinders, deformable beads or rings, etc.), elastic bands, or ties. In one embodiment, micro links, small cylinder beads fabricated with aluminum metal, are used. The interior of the link is gentle on the hair with its protective, cushioned silicone lining, allowing a professional the ability to install the links flatter to the head for maximum comfort to the client. This also allows the links to remain undetectable.

As used in this description, the hair extension method involves clamping, wherein the micro links are clamped to the wearer's natural hair. A clamping tool, such as a pair of pliers, is used to lock or secure the wearer's natural hair and micro links together tightly at the root of the hair, flattening the micro links along the scalp of the wearer.

A special tool is used to pull the wearer's natural hair through one or more of the beads. For example, an instrument with a hook or loop provided at an end thereof, a micro link looping needle, a hair pulling tool, a professional hair tool and/or the like could be used.

As used in this description, the meaning of "hair extensions," includes "weft hair extensions," and "wefts of hair" unless the context clearly dictates otherwise. Hair extensions are a plurality of strands of extension hair and/or a hair weft. Hair extensions vary in thicknesses, lengths, widths, and shapes and is typically not limited to the quantity, thickness, width, length, and arrangement demonstrated in the exemplary drawings. For example, without limitation, longer hair extensions may be implemented for application near the back of a user's head while shorter hair extensions may be implemented for application near crown of scalp. Hair extensions may vary in color and texture in order to blend with a wearer's natural hair.

In one embodiment, a single line, row, column or substantially linear arrangement of hair extensions and/or hair weft is provided. In an alternative embodiment, two or more lines, rows, columns or substantially linear arrangements of hair extensions and/or hair weft are provided. The number of lines, rows, columns and/or the like can vary depending on how thick the hair extension means needs to be.

In one embodiment the hair extensions and/or hair weft are attached to the beads by sewing, such as machine sewing, and/or the like. The wearer's natural hair and the weft hair extensions are sewn together using a needle, such as a curved or suture needle, and thread.

Referring now to the drawings and, in particular, to FIG. 1, wherein a rear view of a wearer's head 21 illustrates a step of hidden row hair extension method 10. In one embodiment, a professional hair stylist determines the desired location on the wearer's head 21 to attach a set of weft hair extensions 34. In this example, the backside of the wearer's head 21 displays one or more part lines 22, separating a wearer's natural hair 33 for installation, in accordance with the present disclosure. In this example, the part line 22 is in the form of an inverted V-shape. Another part line 22 is down the middle of the backside of the wearer's head 21. In other embodiments, alternative shapes, such as a U-shape or a Y-shape, can be utilized.

Figure 2:
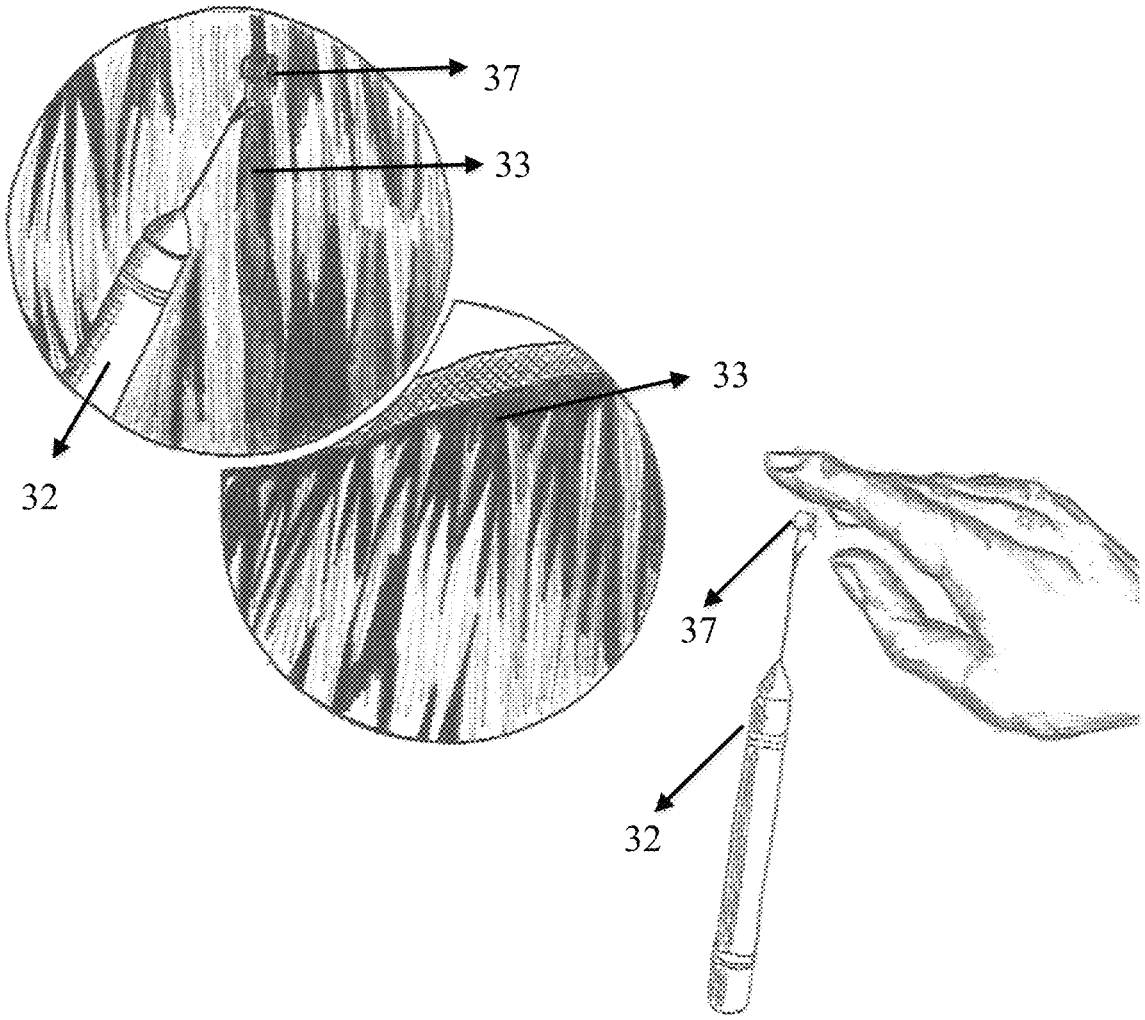
FIG. 2 is an enlarged view illustrating a wearer's natural hair being pulled through a micro link, upon which the method of the present disclosure, in accordance with an embodiment, is practiced.

FIG. 2 illustrates an enlarged view of the application step of the hidden row hair extension method 10, wherein the wearer's natural hair 33 is being pulled through a plurality of beads 37, such as silicone lined micro links. The plurality of beads 37 are applied to the wearer's natural hair 33 by placing one of the plurality of beads 37 on a hooked or looped section of an application tool, such as a micro link looping needle 32. The micro link looping needle 32 is used to pull the wearer's natural hair 33 through the plurality of beads 37.

Figure 3:
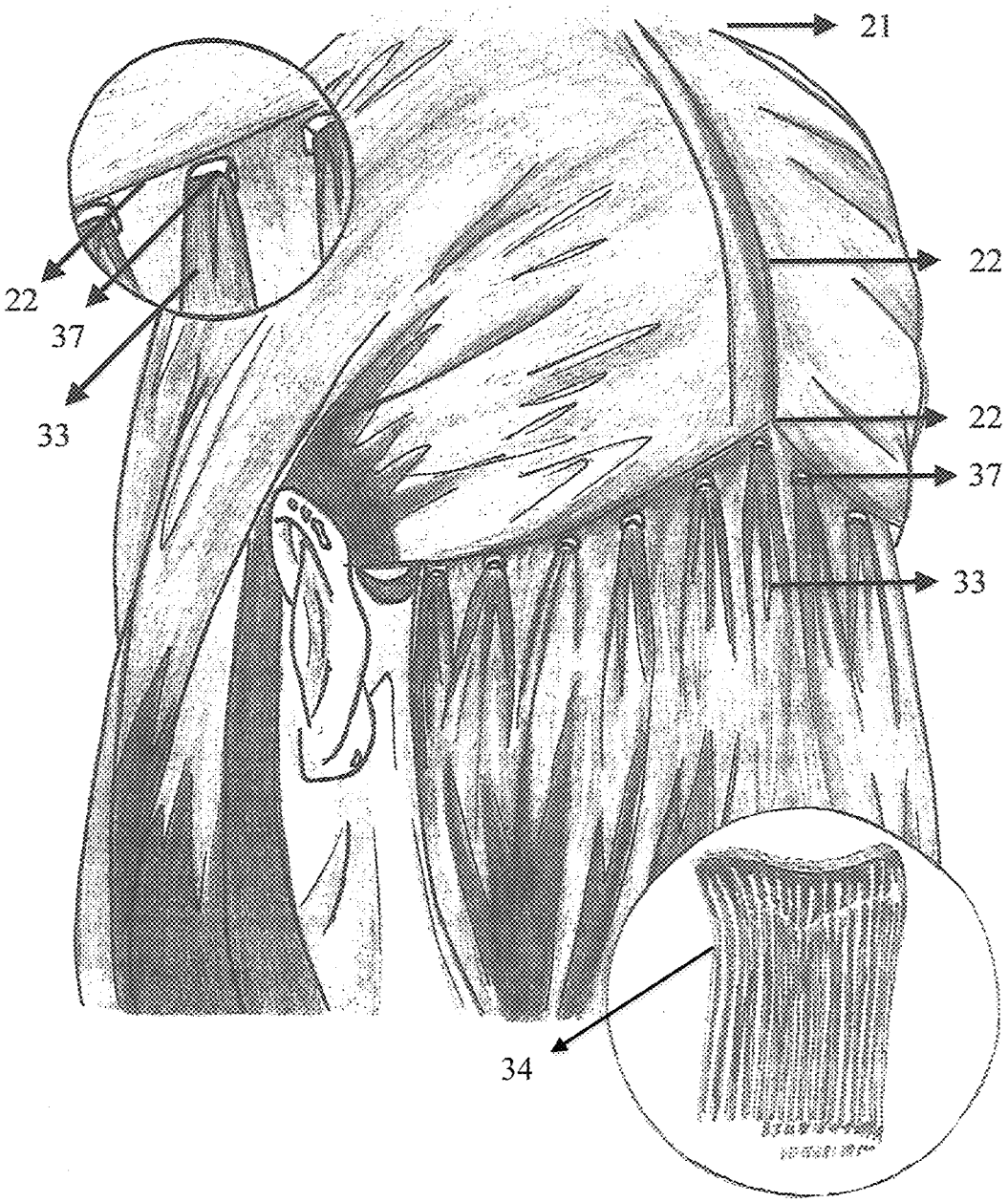
FIG. 3 illustrates another rear view of the wearer's head, further showing the application step of installing weft hair extensions, upon which the method of the present disclosure, in accordance with an embodiment, is practiced.

FIG. 3 illustrates a rear view of the wearer's head 21, displaying the hidden row hair extension method 10, wherein the plurality of beads 37 are provided in horizontal rows, equally spaced apart. The plurality of beads 37 are placed along the desired shape and part line 22 on the backside of the wearer's head 21. The plurality of beads 37 are utilized to feed the wearer's natural hair 33 therethrough and hold the weft hair extensions 34 in place against the wearer's head 21.

Figure 4:
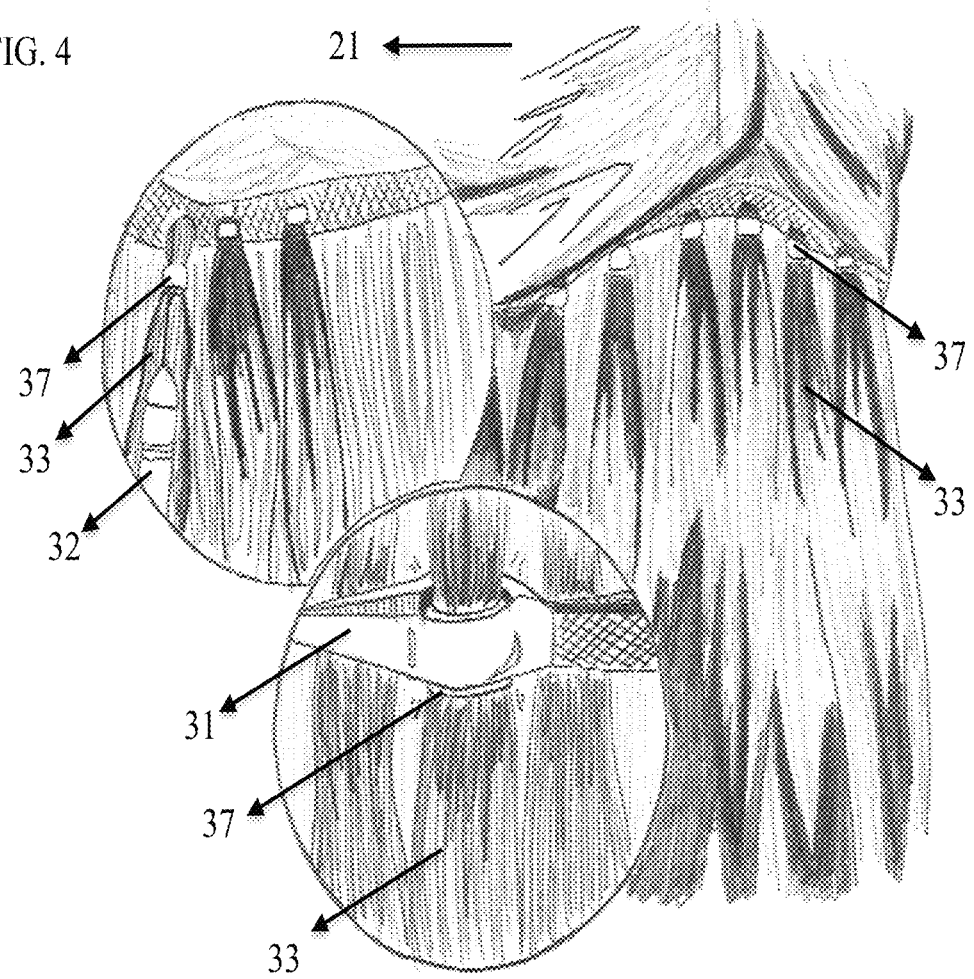
FIG. 4 illustrates a micro link securing a wearer's natural hair, using a pair of pliers.

Referring now to FIG. 4, the backside of the wearer's head 21 illustrates another step of the hidden row hair extension method 10, wherein the wearer's natural hair 33 is secured by clamping. After the wearer's natural hair 33 is passed through the micro link looping needle 32, the plurality of beads 37 are clamped to one or more roots of the wearer's natural hair 33 using a clamping tool, such as a pair of pliers 31.

Figure 5:
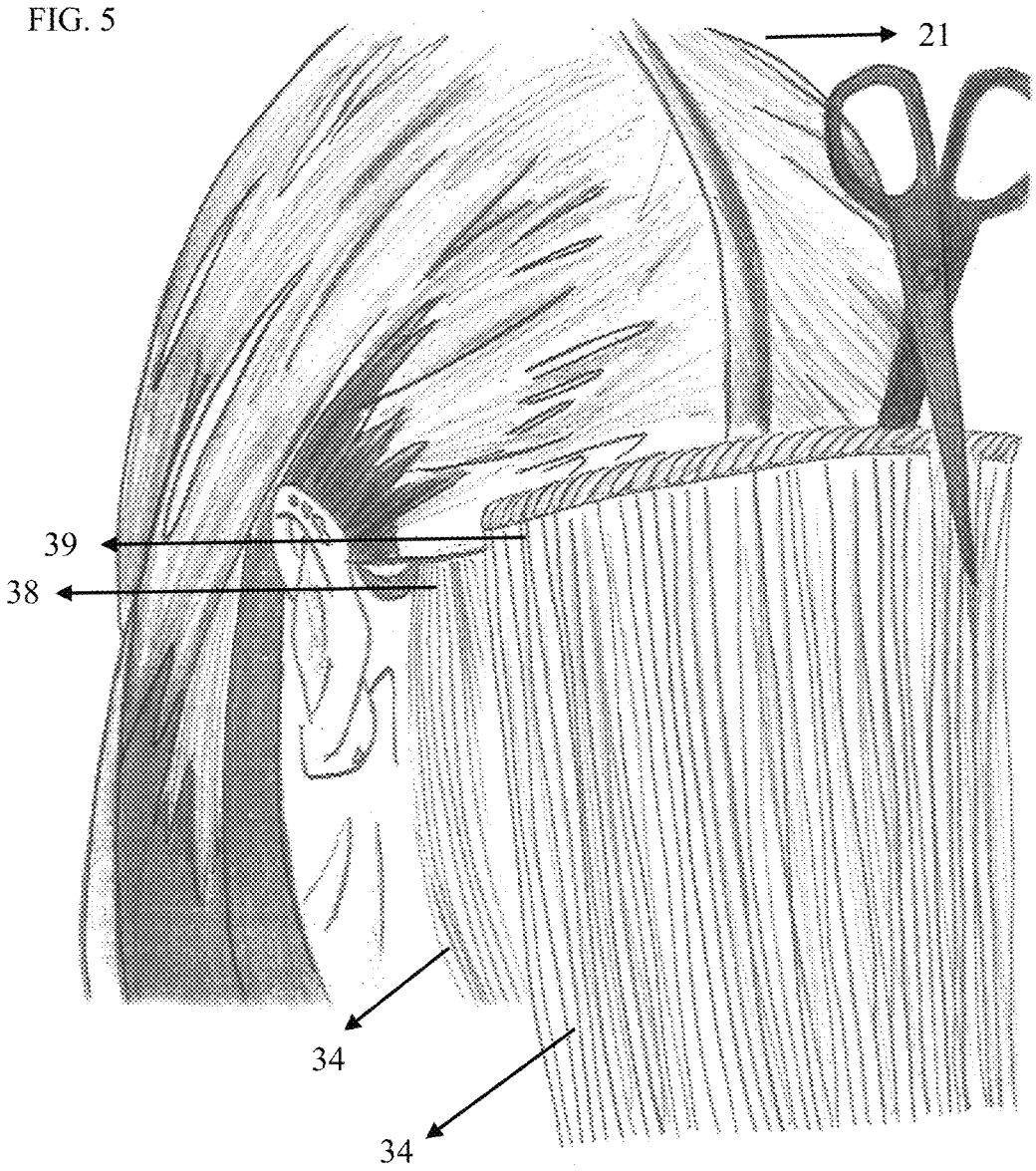
FIG. 5 is a perspective view illustrating the step of cutting the weft hair extensions.

FIG. 5 is a perspective view illustrating another step of the hidden row hair extension method 10, wherein the weft hair extensions 34 are cut. The weft hair extensions 34 are measured to a desired width and desired length to fit the wearer's head 21. The weft hair extensions 34 are cut to create a double layer, the double layer comprising a first layer 38 and a second layer 39. If necessary, the weft hair extensions 34 can be cut or trimmed either vertically or horizontally to conform to the wearer's desired use.

Figure 6:
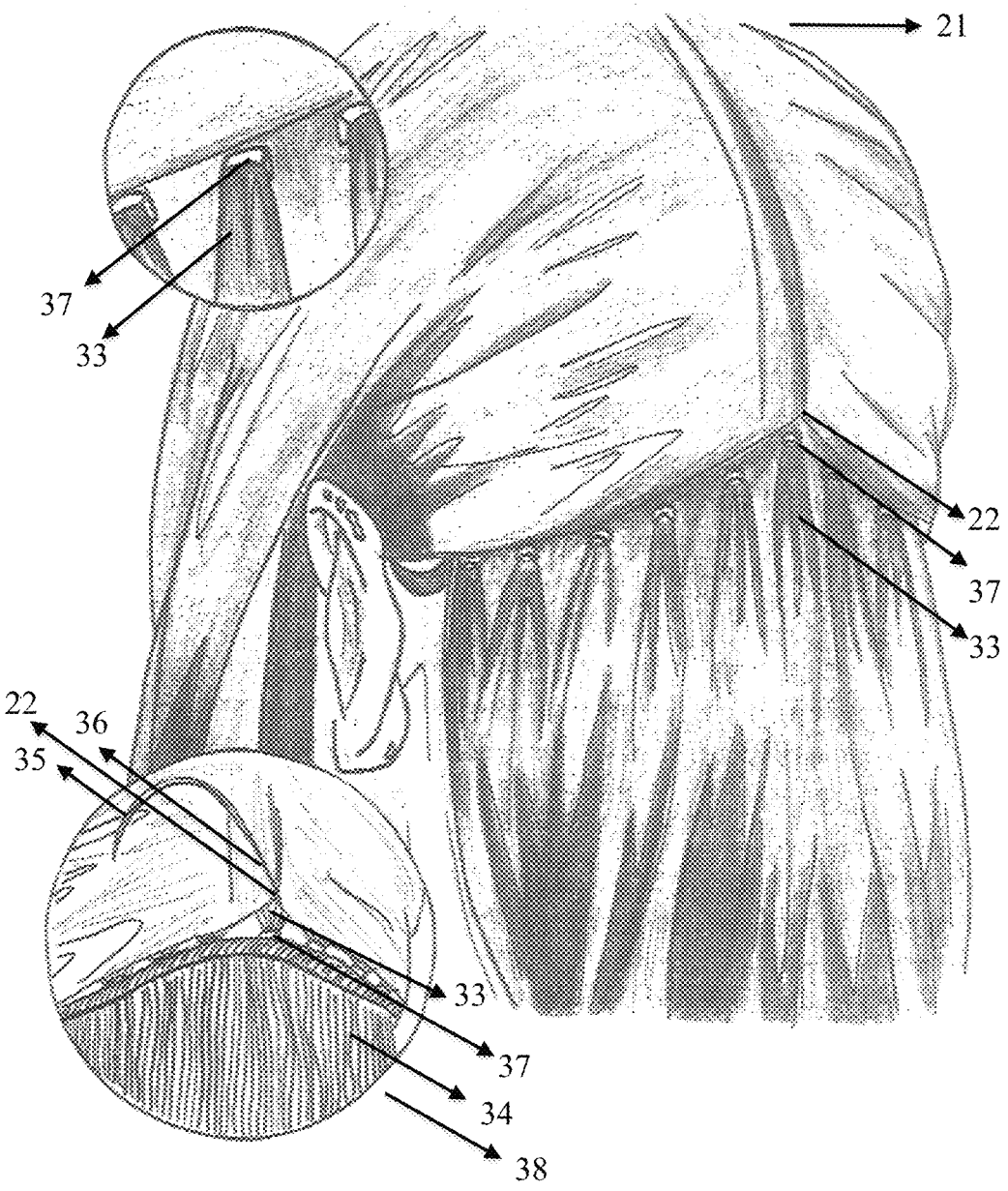
FIG. 6 illustrates another rear view of the wearer's head, further showing a step of installing weft hair extensions, upon which the method of the present disclosure, in accordance with an embodiment, is practiced.

Referring now to FIG. 6, therein illustrated is a rear view of the wearer's head 21 displaying another step of the hidden row hair extension method 10. In one embodiment, the first layer 38 of the weft hair extensions 34 is placed on the underside of the plurality of beads 37 under the part line 22. The hair stylist places the weft hair extensions 34 as close to the wearer's head 21 as possible and substantially flat thereto, in order to conceal the weft hair extensions 34. The wearer's natural hair 33 is sewn through the plurality of beads 37 to the first layer 38. The wearer's natural hair 33 and the weft hair extensions 34 are sewn together using a needle, such as a curved or suture needle 35, and a spindle of thread 36. In one embodiment, the hair extensions and/or hair weft are attached to the beads by sewing, such as machine sewing, and/or the like.

Figure 7:
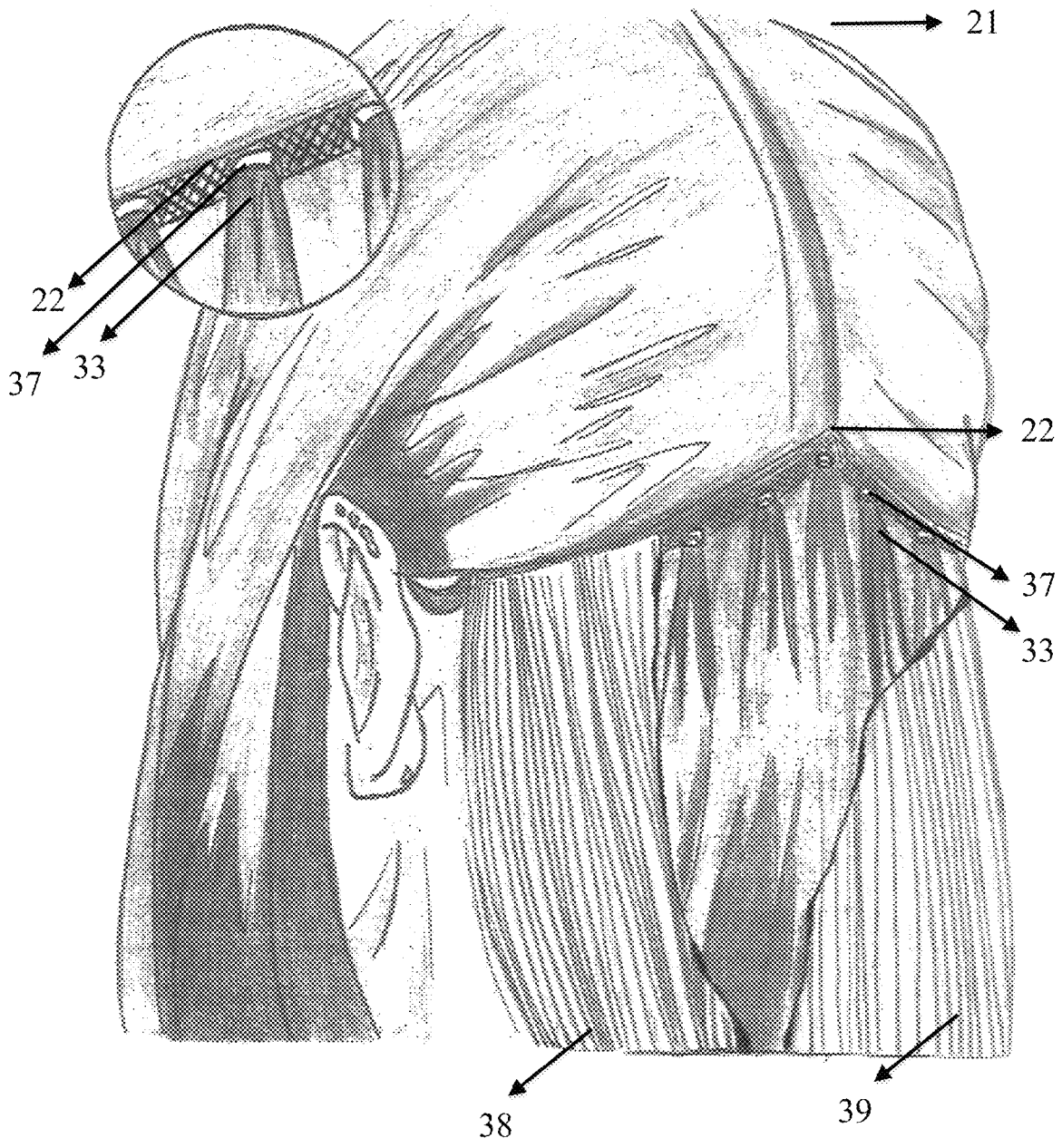
FIG. 7 illustrates another rear view of the wearer's head, further showing a step of installing weft hair extensions, upon which the method of the present disclosure, in accordance with an embodiment, is practiced.

Referring to FIG. 7, therein illustrated is another step of the hidden row hair extension method 10. In another embodiment, the backside of the wearer's head 21 shows the second layer 39 placed on top side of the plurality of beads 37 above the part line 22. The wearer's natural hair 33 is sewn through the plurality of beads 37 to the second layer 39.

Figure 8:
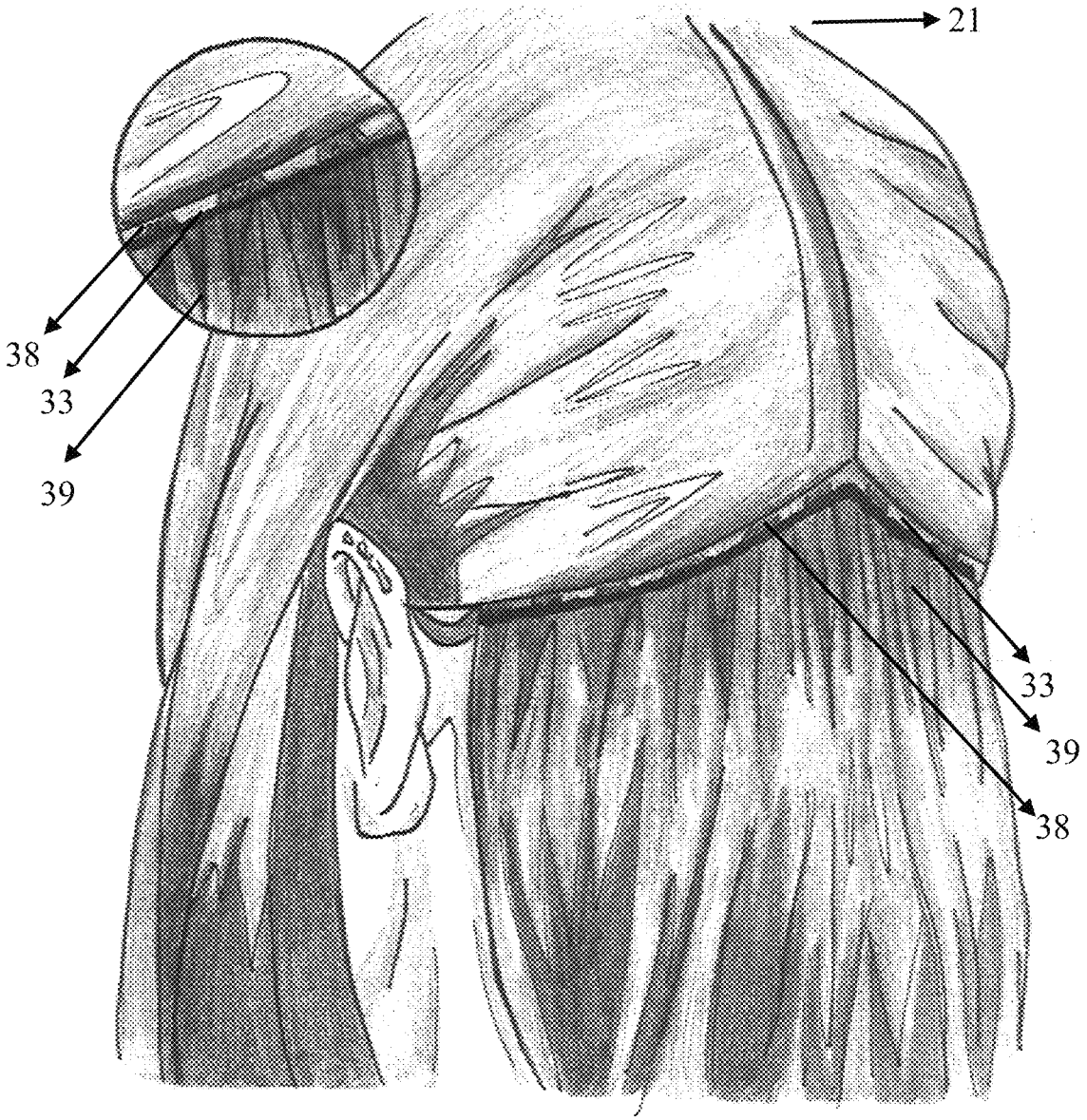
FIG. 8 illustrates another rear view of the wearer's head, showing a complete installation of weft hair extensions, upon which the method of the present disclosure, in accordance with an embodiment, is practiced.

Referring to FIG. 8, the rear view of the wearer's head 21 illustrates the complete hidden row hair extension method 10, wherein the wearer's natural hair 33 is completely sewn through the plurality of beads (see FIG. 7). The plurality of beads (not shown) is concealed and hidden between the first layer 38 and the second layer 39, creating the dual weft hair extension sandwich method of installation (see FIG. 7). In essence, sandwiching the wearer's natural hair.

Figure 9:
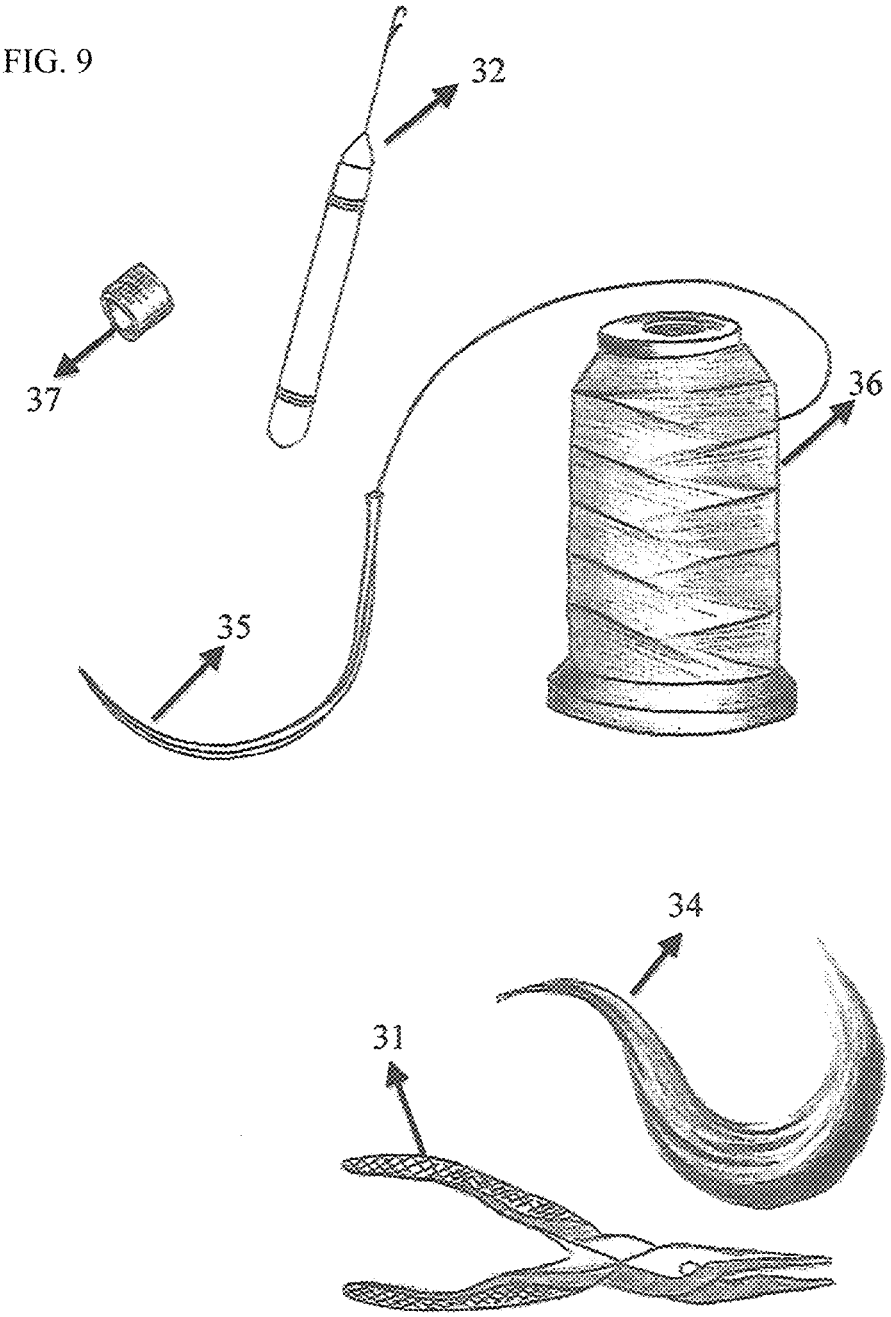
FIG. 9 illustrates a set of tools utilized in the method, in accordance with the principles of the present disclosure.

FIG. 9 illustrates a set of tools 20 utilized for the method of the present disclosure which include but are not limited to: the clamping tool, shown here as the pair of pliers 31, the application tool, shown here as the micro link looping needle 32, the weft hair extensions 34, the needle, shown here as a dull tipped curved or suture needle 35, the spindle of thread 36, and the plurality of beads 37.

It should be understood that the converse to the hidden row hair extension method disclosed in FIGS. 6, 7 is also anticipated. This method could be reversed wherein the second layer of the weft hair extensions placed on top side of the plurality of beads is installed before the first layer of the weft hair extensions is placed on the underside of the plurality of beads.

It should also be understood that additional double layers of the weft hair extensions may be formed above the existing weft hair extensions in the same manner. A separate weft hair extension is used for each layer and the plurality of beads are concealed between the first layer and the second layer of the weft hair extensions, creating the dual weft hair extension sandwich.

For maintenance purposes, the weft hair extensions will be retightened six to eight weeks after installation. To maintain the weft hair extensions, the thread will be cut from the micro links, separating the weft hair extensions from the micro links. The micro links still interconnected to the wearer's natural hair. The micro links will be opened with the pliers and the micro links will be pushed back up to the roots of the wearer's natural hair, as the micro links have grown away from the root of the head due to natural hair growth. The weft hair extensions are then resewn back into place, according to the method of the present disclosure. The micro links can be retightened up to four times before new micro links need to be installed.

To remove the weft hair extensions, the thread will be cut from the micro links, the thread and the weft hair extensions removed from the micro links. The micro links will be opened with the pliers and the micro links will easily slip down and out of the wearer's natural hair. The removal process prevents damage to the wearer's natural hair, reduces hair breakage, and is time efficient, taking no more than five minutes for complete removal.

By utilizing the present method described herein, a safer, non-damaging, more natural means of attaching weft hair extensions to a wearer's natural hair is achieved.

The foregoing description of some embodiments of the disclosure has been presented for purposes of illustration and description. It is not intended to be exhaustive or to limit the disclosure to the precise form disclosed, and modifications and variations are possible in light of the above teachings. The specifically described embodiments explain the principles and practical applications to enable one ordinarily skilled in the art to utilize various embodiments and with various modifications as are suited to the particular use contemplated. It should be understood that various changes, substitutions and alterations can be made hereto without departing from the spirit and scope of the disclosure.

The invention claimed is:

1. A method of attaching weft hair extensions to a wearer's natural hair, comprising the following steps in the following order:

(a) first determining a desired location on a wearer's head where the weft hair extensions are to be attached;

(b) second parting the wearer's natural hair on the wearer's head in a desired shape;

(c) third placing a plurality of beads on to a section of an application tool;

(d) fourth applying the plurality of beads to the wearer's head by passing the wearer's natural hair through the section of the application tool;

(e) fifth clamping the plurality of beads to one or more roots of the wearer's natural hair using a clamping tool;

(f) sixth measuring the weft hair extensions to a desired width and a desired length to fit the wearer's head;

(g) seventh cutting the weft hair extensions to create two layers of the weft hair extensions, the two layers comprising a first layer weft hair extension and a second layer weft hair extension;

(h) eight placing the first layer weft hair extension on an underside of the plurality of beads;

(i) ninth sewing the wearer's natural hair through the plurality of beads to the first layer weft hair extension;

(j) tenth placing the second layer weft hair extension on the top side of the plurality of beads; and (k) eleventh sewing the wearer's natural hair through the plurality of beads to the second layer weft hair extension, wherein the plurality of beads are located between the first layer weft hair extension and the second layer weft hair extension.

2. The method of claim 1, wherein the weft hair extensions comprise a hair attachment weave.

3. The method of claim 1, wherein the at least one of the plurality of beads further comprises micro links for feeding the wearer's natural hair therethrough the micro links and holding the weft hair extensions in place against a wearer's scalp.

4. The method of claim 1, wherein the section of the application tool comprises a looping or hooked section.

5. The method of claim 1, wherein the application tool comprises a micro link looping needle.

6. The method of claim 1, wherein the at least one of the plurality of beads are arranged in horizontal rows, equally spaced apart.

7. The method of claim 1, wherein the clamping tool is used for securing the at least one of the plurality of beads onto the wearer's natural hair.

8. The method of claim 7, wherein the clamping tool comprises a pair of pliers.

9. The method of claim 1, wherein sewing the wearer's natural hair and the weft of hair extensions is performed using needle and thread.

10. The method of claim 9, wherein the needle comprises a curved or suture needle.

* * * * *